US005624362A

United States Patent [19]

Wilson

[11] Patent Number: 5,624,362

[45] Date of Patent: Apr. 29, 1997

[54] PUNCHING HANDLE ACCESSORY

[76] Inventor: Thomas I. Wilson, 243 Soule Rd., Wilbraham, Mass. 01095

[21] Appl. No.: 646,692

[22] Filed: May 6, 1996

Related U.S. Application Data

[63] Continuation-in-part of Ser. No. 174,846, Dec. 29, 1993.

[51] Int. Cl.[6] ..... A63B 21/00

[52] U.S. Cl. ..... 482/139; 482/83; 482/102; 482/129

[58] Field of Search ..... 482/83, 92, 89, 482/93, 94, 97–103, 112, 123, 129, 130, 133, 138, 139, 148

[56] References Cited

U.S. PATENT DOCUMENTS

| | | | |
|---|---|---|---|
| 2,648,540 | 1/1953 | Hunter | 482/102 |
| 4,749,185 | 6/1988 | Spears | 482/89 |
| 5,399,133 | 3/1995 | Habel et al. | 482/139 X |

*Primary Examiner*—Joe Cheng
*Assistant Examiner*—John Mulcahy

[57] ABSTRACT

A punching handle accessory of simplified design and construction which enables a user to perform various natural, unobstructed punching motions, while overcoming a cable actuated resistance. An elongated, crescent shaped mounting bracket provides a resistance connection point on each end. A pressure plate is attached to the mounting bracket by a spindle. The spindle attaches the pressure plate to the concave side of the crescent shaped elongated mounting bracket generally midway between the resistance connection points. The spindle allows the pressure plate to rotate on the mounting bracket along an axis which is generally perpendicular to a straight line passing through the resistance connection points on the elongated mounting bracket. A non-supportive handle cross member is attached to the pressure plate. This handle cross member, when grasped in a user's palm, only correctly positions the user's fist in relation to the rotational centerline of the pressure plate and spindle. The handle cross member will not support a user's fist by the palm away from the pressure plate. Therefore all resistance is placed against the knuckles of a user's fist. Resistance is provided from above and below the punching handle accessory by cable ends attached to the resistance connection points on the elongated mounting bracket.

11 Claims, 8 Drawing Sheets

PUNCHING HANDLE ACCESSORY

CROSS REFERENCE TO RELATED APPLICATIONS

This application is a continuation in part of application Ser. No. 08/174,846 filed Dec. 29, 1993.

BACKGROUND

1. Field of Invention

This invention relates to custom handle accessories used with cable actuated exercise equipment.

2. Description of Prior Art

Many people like to have confidence in their ability to defend themselves, and a punch is arguably the most commonly used method for this self defense.

Of course there are many ways to increase punching power. For example, free weights increase muscular strength, and their use will increase punching power. However, free weights only work the muscles. They do not train muscles of the body to work in harmony during proper punching movements.

On the other hand, a punching bag such as U.S. Pat. No. 5,183,450 to Stelmach (1993), or rigid target equipment as described in U.S. Pat. No. 4,973,045 to Heberer (1990), promote good punching form, but do not work the muscles sufficiently throughout an actual punching motion. In addition, the practice of punching a heavy or fixed target, can cause injury. Injuries are typical of the high impacts associated with punching the above mentioned, or similar exercise equipment. While some practitioners of self defense do tout the need for the feel of an actual blow against a heavy or rigid target, it is generally accepted that high impact exercises are detrimental to health and fitness improvements.

OBJECTS AND ADVANTAGES

So, muscular strength, harmony of muscle movements in a puncher's body, and sound punching technique are all critical to good punching power. In fact, just training to attain the proper punching motions greatly increases punching power, even if actual muscle strength remains unchanged.

By the same token, if the muscles of a puncher's body are trained to move in unison, and the puncher's muscle strength is increased simultaneously, the quality of the exercise movement can be considered improved. Therefore, an exercise device which often resistance throughout a natural, unobstructed punching motion, without ending that beneficial exercise motion with high impact, is desirable. Boxers, martial arts enthusiasts, or anyone wishing to improve their punching power, would benefit from such a device.

SUMMARY OF THE INVENTION

It is the object of this invention to increase the invention user's punching power throughout a natural, unobstructed punching motion, while eliminating the harmful impacts associated with punching bags, and other resistive or rigid target type equipment. This is how my invention achieves these two goals:

a. Provide for attachment to an appropriate cable actuated resistance so that resistance is given throughout a 100% natural, unobstructed punching motion. All resistance is placed against the knuckles of the fist of a punching handle accessory user. Also, a user is not hindered with obstacles such as resistance cable to body interference, or an inability to rotate the fist during punching motion.

b. There is no impact upon a target at the end of the punching motion. The punching handle accessory user simply completes a full punching motion, then returns to the start position ready for another repetition.

The Applicant's punching handle accessory is a unique way to offer resistance throughout a 100% natural punching motion. One feature of my invention that helps achieve this capability is a mounting bracket which allows simultaneous use of upper and lower resistance cable connections. Thus allowing resistance to come from generally above and below, instead of from behind, a punching handle accessory user. Since an ordinary punch involves generally forward and rearward movement, there is no resistance cable interference with the arm movements of a user of my punching handle accessory. Also, my punching handle accessory allows a user's fist to rotate independently from the resistance cable(s). This rotation is provided by a pressure plate which is spindle mounted to the mounting bracket. A user places the knuckles of a fist against the spindle mounted pressure plate, while performing a completely natural punching motion.

And finally, my punching handle accessory places all resistance against the knuckles of a user's fist. This last characteristic is contributed by a non-supportive handle cross member attached to the pressure plate. The non-supportive handle crossmember only serves to guide a user's fist to the proper position on the pressure plate. The non-supportive handle cross member will not support a user's fist away from the pressure plate. Therefore all resistance remains against the knuckles of a user's fist, not against the palm of a user's fist. This feature is a critical aspect of a 100% natural punching motion. Placing resistance against the knuckles instead of the palm increases leverage on the wrist, working the wrist and forearm harder. Therefore, the wrist and forearm will be strengthened accordingly. This feature of my punching handle accessory better prepares a user's wrist for throwing actual punches, where all resistance is also against the knuckles of the fist.

Any cable actuated resistance which provides for simultaneous use of an upper and lower resistance cable would be an effective utilization of my punching handle accessory. Ideally, the resistance cable should be suspended from an aligned configuration of pulleys attached to a framework. The pulley configuration should provide a tall (at least shoulder height), generally vertical section of cable. An optimal configuration would place this vertical section between two swivel mounted pulleys. I refer to this generally vertical section of cable as the resistance offering area, and my punching handle accessory is positioned within it. In an appropriate place, away from the resistance offering area, the cable and pulley configuration should allow for attachment to a resistance. I refer to this area as the resistance well. In this resistance well, a weight assembly is suspended. The motion of the weight assembly is up and down vertically. This vertical motion may or may not be controlled by a guide assembly. The weight assembly is lifted whenever cable is removed from the resistance well. Cable is removed from the resistance well when my punching handle accessory moves in any direction not parallel to the generally vertical section of the resistance offering area. The amount of resistance given from the resistance well should be variable. Varying the resistance by using graduated weight plates carried by any suitable weight carrying assembly would be acceptable. Also, the cable actuated resistance should allow my punching handle accessory to move up and down within the resistance offering area. This makes my punching handle accessory's position adjustable for variations in punching motion and user height.

REFERENCE NUMERALS IN DRAWINGS

In the drawings, closely related parts have the same number but different alphabetic suffixes.

| | |
|---|---|
| 20 Punching Handle Accessory | 51 Lower Resistance Cable |
| 21 Mounting Bracket | 52 Resistance Offering Area |
| 22 Flexible Non-Supportive Handle Cross Member | 53 Resistance Well |
| 22a Rigid Non-Supportive Handle Cross Member | 54 Resistance Cable Loop |
| 22b Rigid Non-Supportive Handle Cross Member | 55 Resistance Cable |
| 22c Rigid Non-Supportive Handle Cross Member | 56 Resistance Cable Loop |
| 23 Upper Guide | 70 Frame |
| 23a Upper Guide | 71 Frame Mount |
| 23b Guide Post | 80 Pivot Block |
| 24 Lower Guide | 81 Pivot Arm |
| 24a Lower Guide | 100 Weight Assembly |
| 25 Unsecured End | 100a Weight Assembly With Floating Pulley 102 |
| 25a Secured End | 101 Frame Mounted Pulley |
| 26 Pressure Pad | 102 Floating Pulley |
| 27 Pressure Plate | 103 Floating Pulley Block |
| 28 Spindle | 135 Frame Mounted Swivel Pulley |
| 29 Dowel | 136 Floating Swivel Pulley |
| 30 Resistance Connection Point | 150 Elongated Openings |
| 50 Upper Resistance Cable | |

DRAWING FIGURES

In the drawings, closely related figures have the same number but different alphabetic suffixes.

Figure 5:
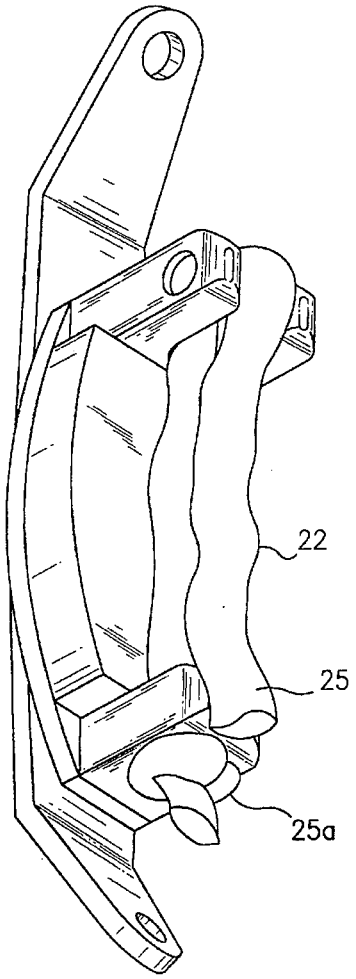
FIG. 5 shows a back view of a punching handle accessory with a flexible non-supportive handle cross member.
Figure 5C:
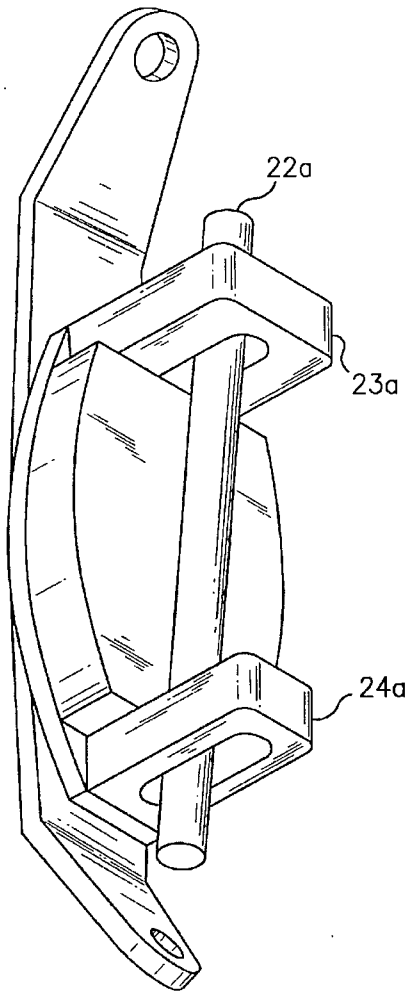
Figure 5B:
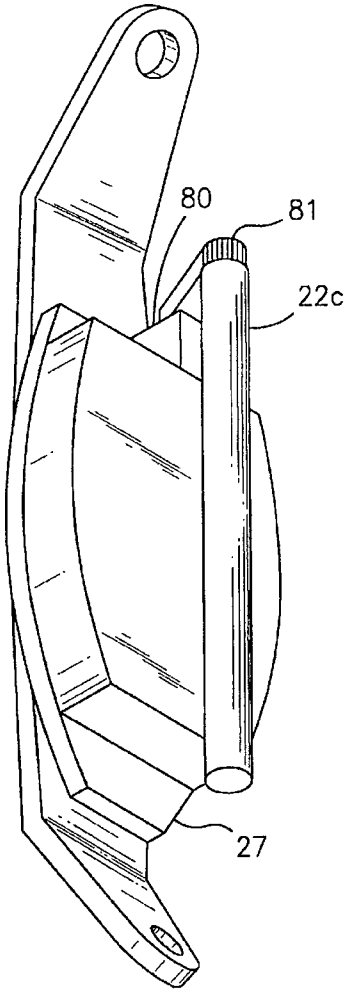
Figure 5A:
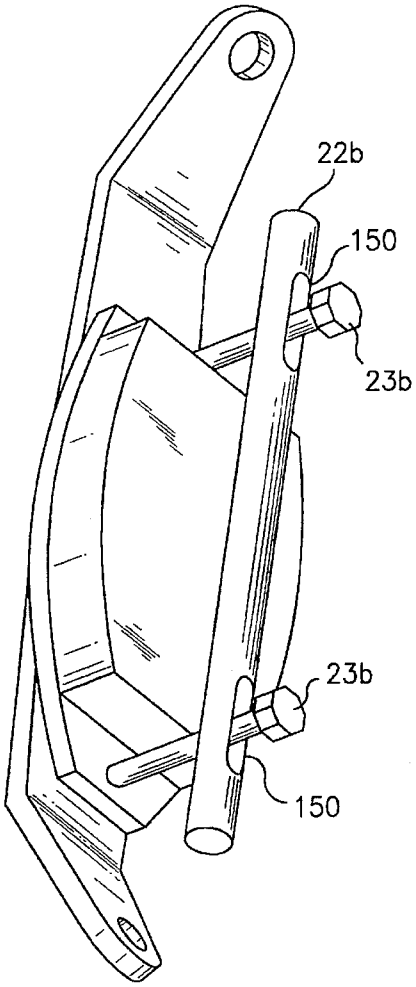

FIGS. 5*a*, 5*b*, and 5*c* show a back view of punching handle accessories with various styles of rigid non-supportive handle cross members.

Figure 6:
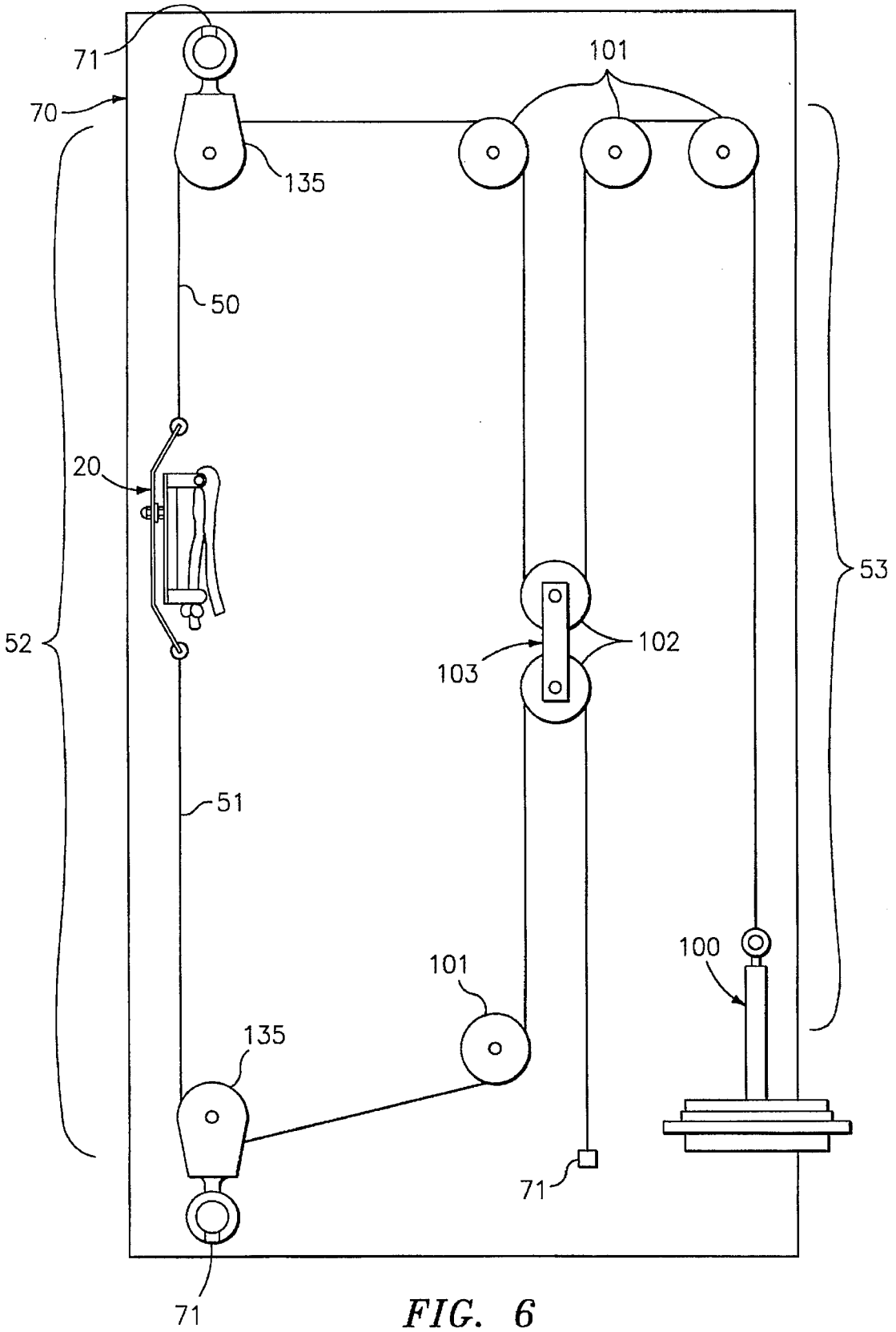

FIG. 6 shows an abbreviated drawing of a possible application for the punching handle accessory.

Figure 7:
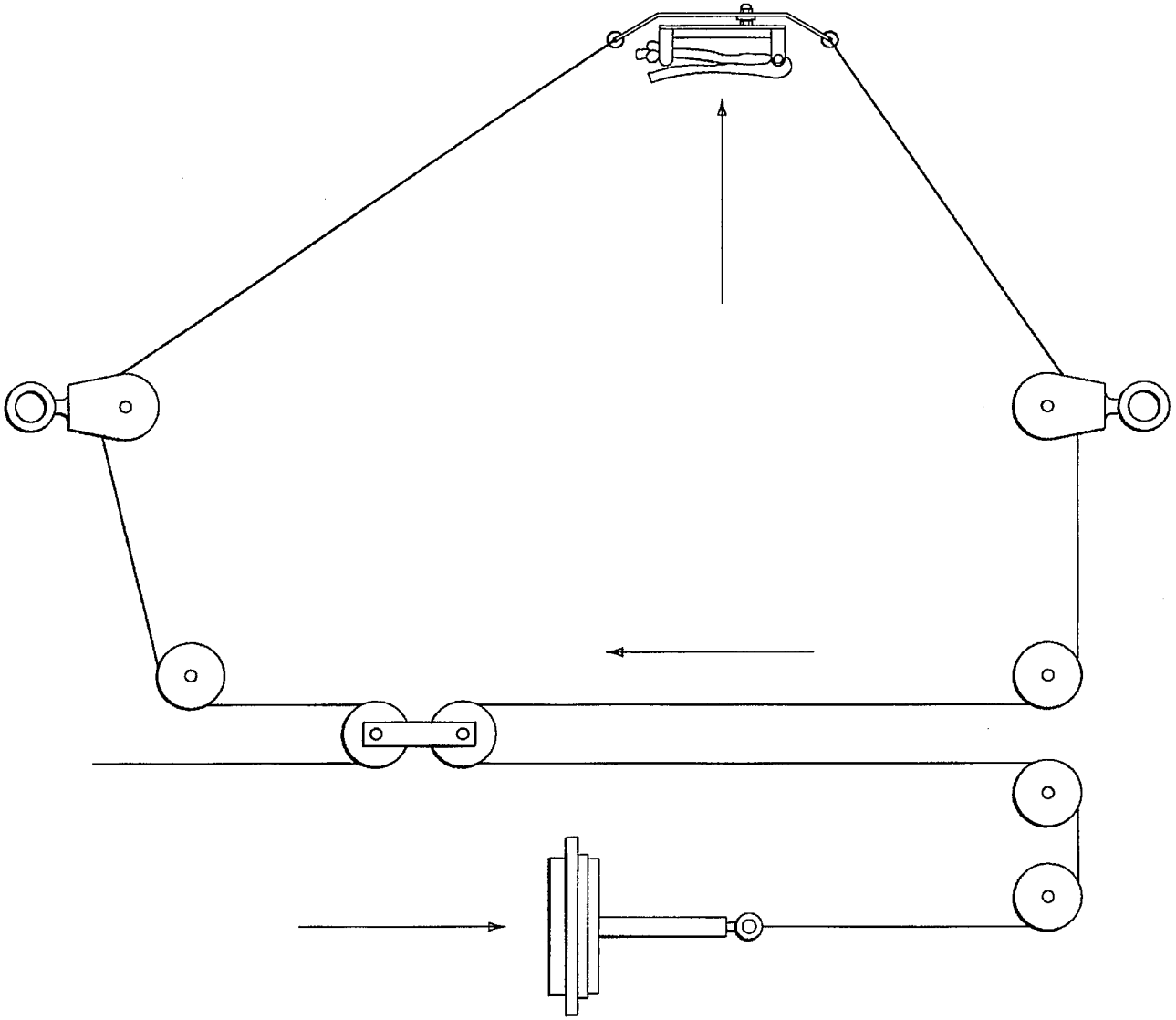

FIG. 7 shows an abbreviated drawing of an extended resistance offering area.

Figure 8:
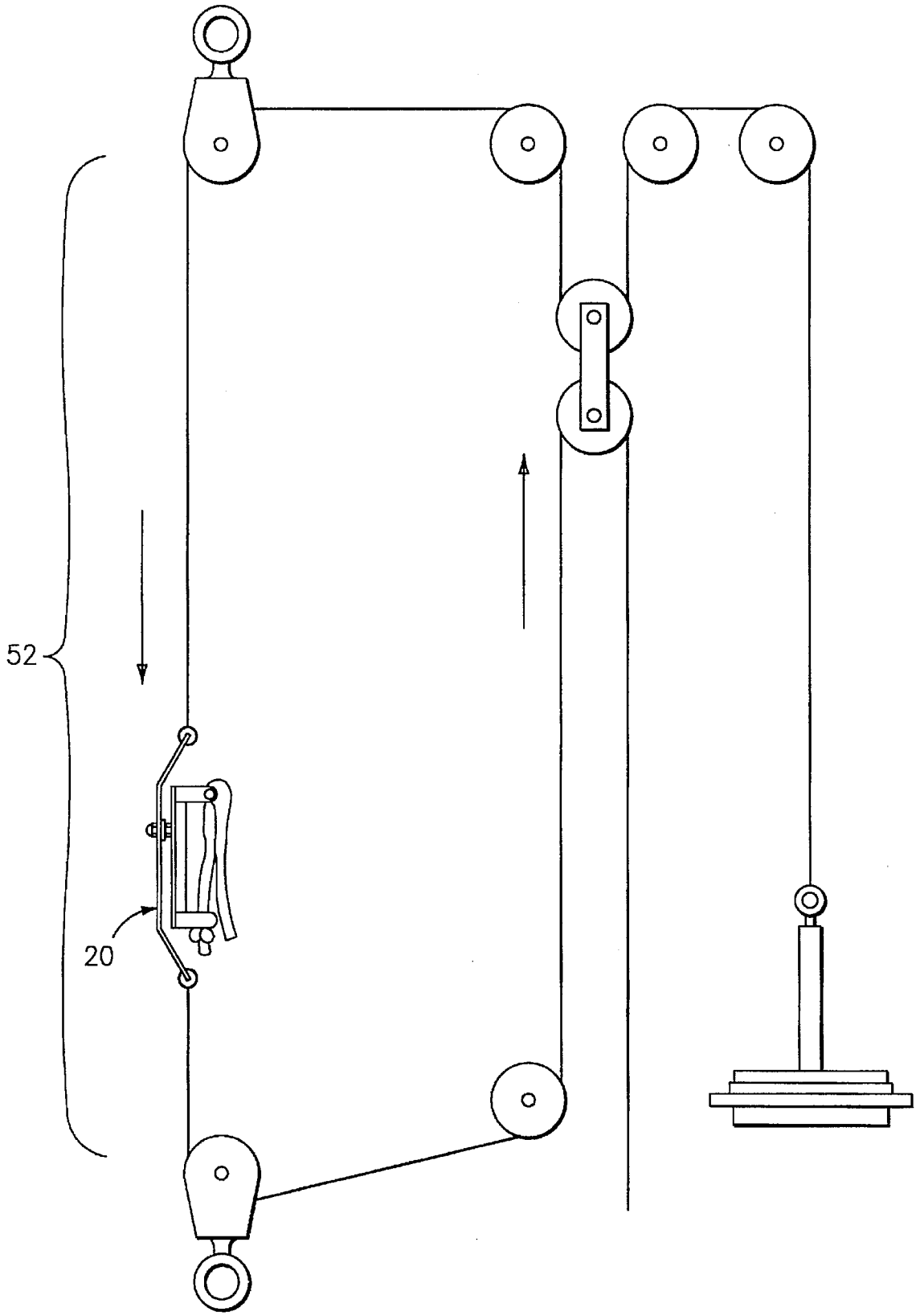

FIG. 8 shows the desired height position adjustment within the resistance offering area of a punching handle accessory.

Figure 9:
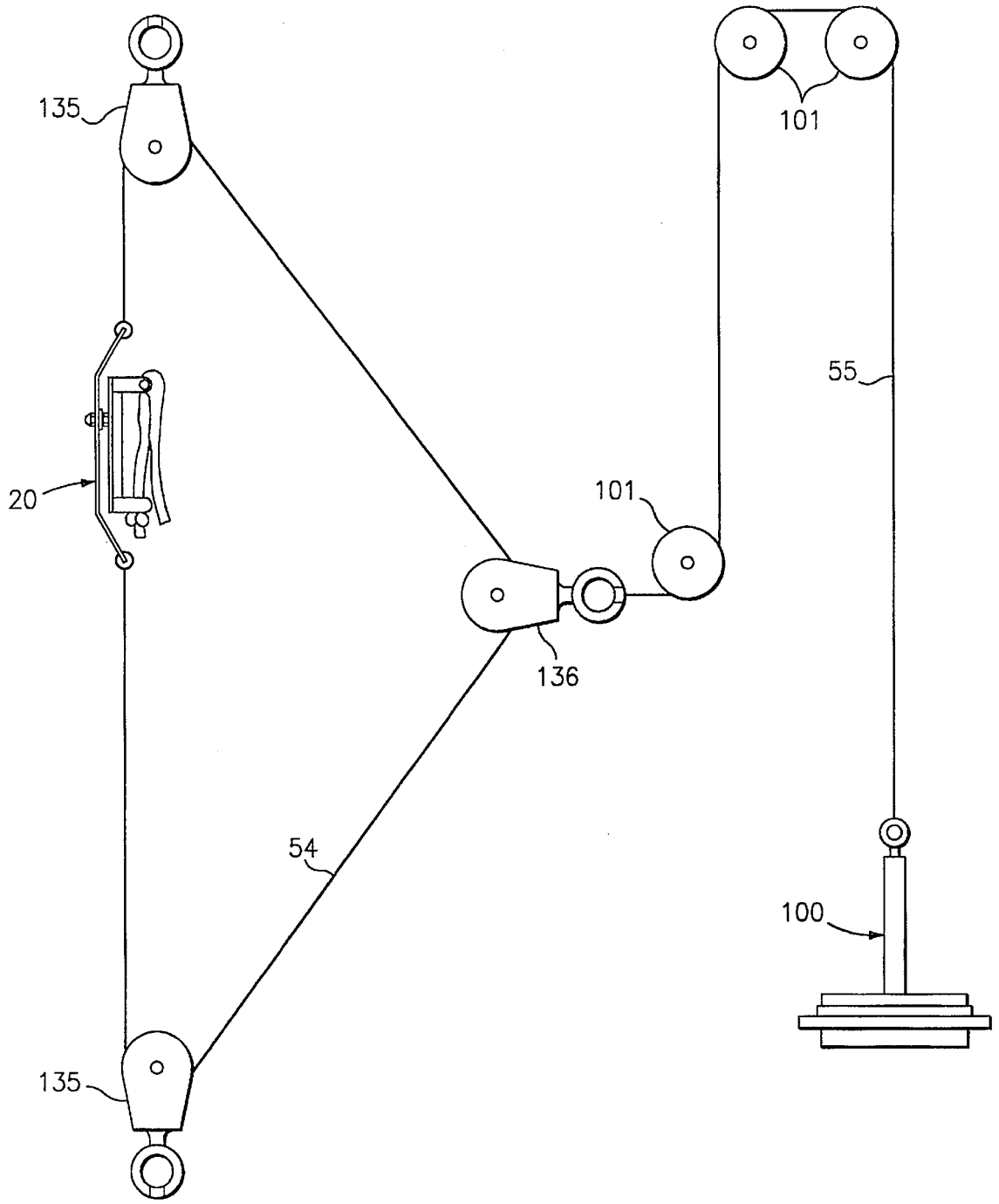

FIG. 9 shows an abbreviated drawing of a possible application for the punching handle accessory.

Figure 10:
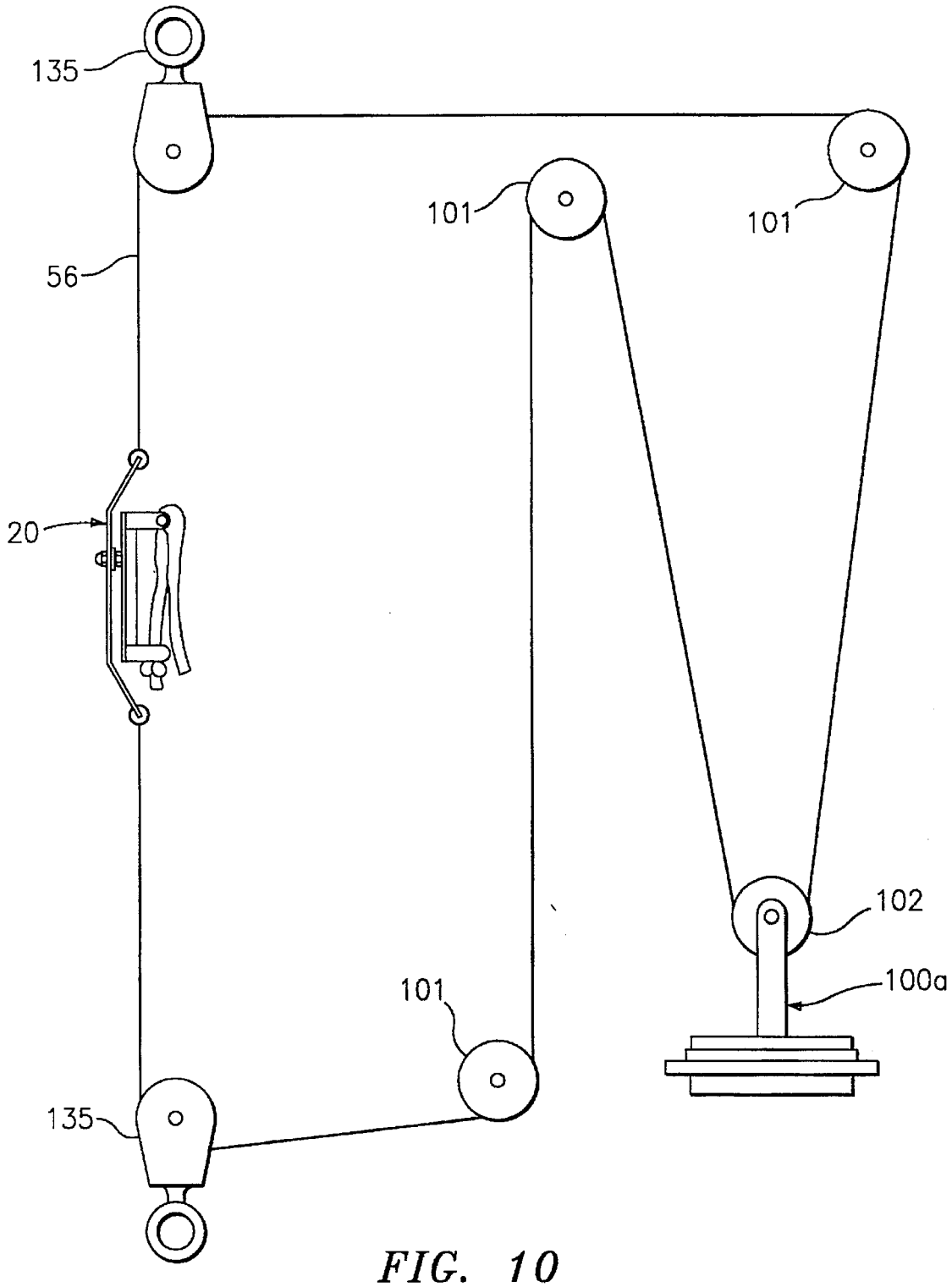

FIG. 10 shows an abbreviated drawing of a possible application for the punching handle accessory.

DESCRIPTION

I will first describe one possible application of my punching handle accessory invention coupled with a single cable actuated resistance. However, in my preferred embodiment, two punching handle accessories with two corresponding cable actuated resistances, are placed side by side. This embodiment would allow both arms of a user to be exercised simultaneously, making the exercise motion more like an actual self defense situation.

Figure 3:
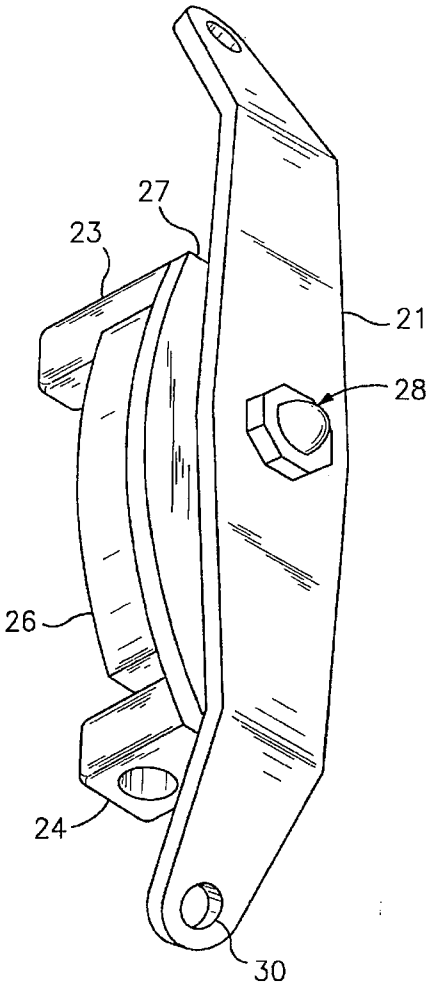
FIG. 3 shows a front view of a punching handle accessory without a flexible non-supportive handle cross member.
Figure 2:
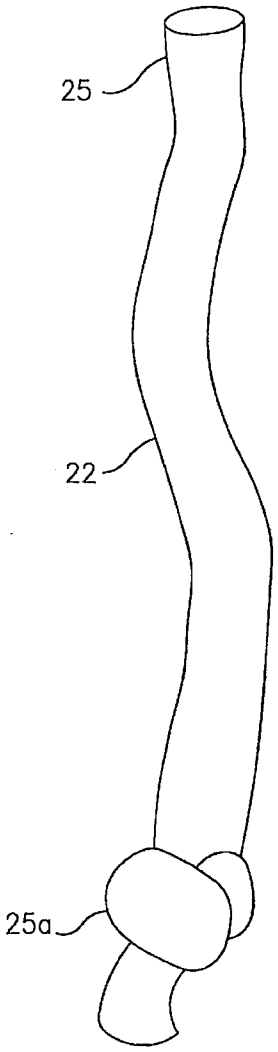
FIG. 2 shows a flexible non-supportive handle cross member.
Figure 1:
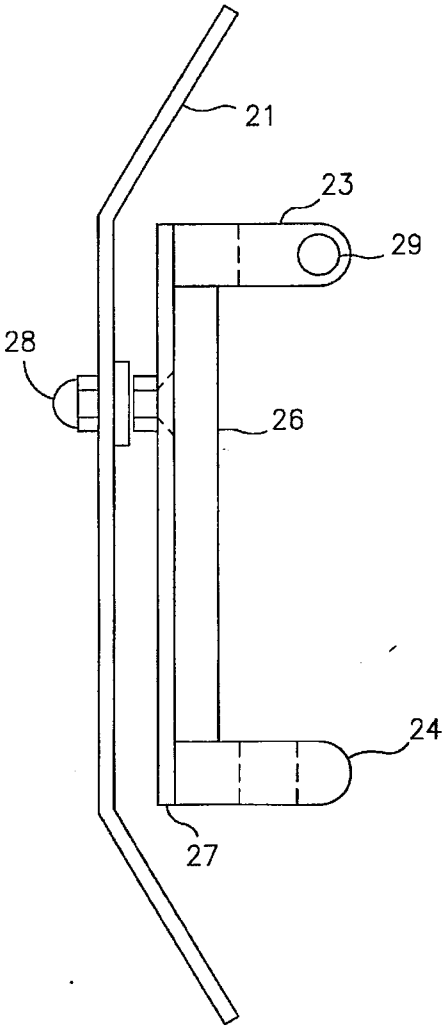
FIG. 1 shows a left side view of a punching handle accessory without a flexible non-supportive handle cross member.
Figure 4:
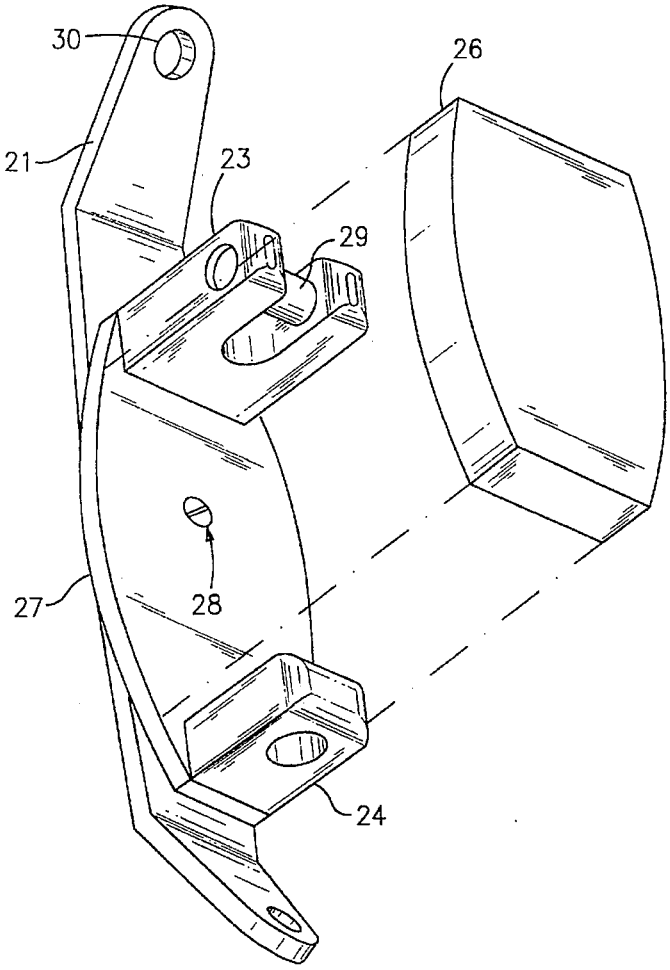
FIG. 4 shows a punching handle accessory with the pressure pad and flexible non-supportive handle cross member removed for clarity.

FIGS. 1, 2 and 4:

Punching handle accessory 20 comprises;

An elongated mounting bracket 21 with angled ends which give it a generally crescent shape. There is also a resistance connection point 30 on each end of mounting bracket 21. A pressure plate 27 is attached by spindle 28 to elongated mounting bracket 21. An upper guide 23 and lower guide 24 are attached to pressure plate 27. A dowel 29 is mounted within upper guide 23. Unsecured end 25 of flexible non-supportive handle cross member 22 is threaded through lower guide 24. Then, unsecured end 25 is threaded around dowel 29. Secured end 25*a* will not pass through lower guide 24. Pressure pad 26 is located between upper guide 23 and lower guide 24. Pressure pad 26 is not rigidly attached to pressure plate 27. Instead, the elastic nature of pressure pad 26 allows it to be non permanently wedged between upper guide 23 and lower guide 24. This characteristic of pressure pad 26 allows for easy removal, remounting, or substitution of the pad.

FIG. 6, 7, 8, 9, and 10:

The only necessary features of an appropriate cable actuated resistance are:

generally aligned upper and lower resistance cable ends which can be joined end to end by mounting bracket 21. Any type of flexible, elastic line, suitably anchored above and below mounting bracket 21 would allow proper functioning of my punching handle accessory.

However, the features for a standard, variable resistance, cable actuated exercise device should include which ever necessary cables 50, 51, 54, 55, or 56 and;

a suitable framework 70, a series of pulleys 101, 102, 135, and 136 (pulley 136 appears in FIG. 9 only)

a weight assembly 100, and 100*a* (weight assembly 100*a* appears in FIG. 10 only)

Ideally, pulley's 135 above and below resistance offering area 52 should be swivel mounted to frame 70. This configuration will give a very broad range of directions for movement that a punching handle accessory user can choose from.

Operation

FIGS. 6, 7, 8, 9, and 10:

The Applicant's punching handle accessory 20 can only be used with a cable actuated resistance which possesses an ability giving simultaneous use of upper and lower resistance cable ends. FIGS. 6, 7, 8, 9, and 10 show examples of possible cable and pulley configurations which would work with the Applicants punching handle accessory invention. The punching handle accessory 20 is attached to the cable actuated resistance by two resistance connection points 30 on mounting bracket 21. The angled ends of mounting bracket 21 reduce the tendency of mounting bracket 21 to rotate along an axis generally perpendicular to the axis of spindle 28. This tendency to rotate occurs when user applied force to the pressure plate 27 is off center to mounting bracket 21. Reducing the tendency of mounting bracket 21 rotation is critical to easy operation for punching handle accessory 20.

A punching handle accessory user takes an appropriate stance slightly forward and to one side of the resistance offering area 52 (left or fight depending on which arm is being exercised). The user then engages punching handle accessory 20 as set forth below in the operational description for FIG. 5. The user then performs the desired punching motion.

FIG. 5:

A punching handle accessory 20 user places the knuckles of a hand against pressure pad 26. Then flexible non-supportive handle cross member 22 is placed in the palm of the same hand. Unsecured end 25 is pulled taut. Now, both lengths of flexible non-supportive handle cross member 22 are grasped firmly in the palm. The user's grip on flexible non-supportive handle cross member 22 must remain firm at all times for handle accessory 20 to function properly during a punching motion. Thus, flexible non-supportive handle cross member 22 forces the punching handle accessory 20 user to concentrate on keeping a tightly clenched fist, which is proper form during punching techniques. Also, flexible non-supportive handle cross member 22 only serves to correctly position a user's fist in relation to the pressure plate 27 and spindle 28, while limiting lateral movement of the user's fist. Flexible non supportive handle cross member 22 will not support a user's fist away from the pressure pad 26. Therefore all resistance force is directed against a user's knuckles as in an actual punch. This feature will strengthen the forearm muscles of a user, which in turn will strengthen the user's wrist. This increased wrist strength will lower the risk of wrist injury during circumstances where a user must throw actual punches in a real self defense situation.

In addition, the pivotal axis supplied by spindle 28 allows rotation of the user's fist that is independent of the resistance cable ends. Therefore, users will not have to overcome the considerable resistance employed to exercise the large muscles of the upper arm in order to rotate their fist during the punching motion. Even though rotation of the fist is proper form during most punching techniques, it is optional, and not necessary for the functioning of the Applicant's punching handle accessory.

FIG. 7:

When a punching handle accessory 20 user performs a punching motion, resistance offering area 52 is displaced. Thus cable is removed from the resistance well 53, and weight assembly 100 is lifted.

FIG. 8:

The cable and pulley configuration should allow the height position of handle accessory 20 to change freely within resistance offering area 52. This feature would increase the versatility of handle accessory 20 by:

accommodateing differences in punching handle accessory user height, and allowing upward and downward variations in the angle of a punching motion.

The non-supportive handle cross member is a critical feature of the punching handle accessory. All resistive force must be against a user's knuckles in order to maintain the 100% natural punching motion. Wrist and forearm strength are very important in preventing injuries when hard punches are being thrown. And when the resistance is placed against the knuckles of a user's fist during exercise movement, the wrist and forearm are worked harder, and thus better prepared for throwing actual punches in a real self-defense situation.

FIGS. *5a, 5b, 5c:*

Flexible non-supportive handle cross member 22 and accompanying upper guide 23 and lower guide 24 may be substituted with the following;

a rigid non-supportive handle cross member **22*b*, and guide posts 23*b***;

a rigid non-supportive handle cross member **22*a*, upper guide 23*a*, and lower guide 24*a***;

a rigid non-supportive handle cross member **22*c*, attached to pressure plate 27 by pivot block 80 and pivot arm 81**.

FIG. 4:

Pressure pad 26 is not necessary for proper function of punching handle accessory 20. Pressure pad 26 is an option serving only to make the exercise movement more comfortable for a user. The pressure pad 26 is removable, and may be left out if the user desires a harder surface against his/her knuckles. Or, pressure pad 26 may be custom molded to specifically fit the size and shape of an individual user's fist. Also, the user may wear a glove in place of pressure pad 26.

FIG. *5a:*

Rigid non-supportive handle cross member **22*b* engages guide posts 23*b* through elongated openings 150 to ensure smooth, non binding movement of cross member 22*b* on guide posts 23*b*. Also, elongated openings 150 in cross member 22*b*** allow freedom of movement giving non supported alignment to a users palm, ensuring all resistance remains against the knuckles of a user's fist.

Conclusion

All the features of the Applicant's punching handle accessory in combination with an appropriate cable actuated resistance promote the exercise punching motion to a very natural, unobstructed punching movement. Specifically increasing punching power throughout the full range of movement, while eliminating the harmful impacts associated with punching bags, and other resistive target type equipment.

Thus the reader will see that my punching handle accessory invention provides a highly reliable, lightweight, yet economical exercise device which can be used by almost anyone who wishes to increase their punching power.

And while my above description contains many specificities, these should not be construed as limitations on the scope of the invention, but rather as an exemplification of one preferred embodiment thereof. Many other variations are possible. For example, flexible non-supportive handle cross member 22 may be substituted with a plurality of such handle cross members. Also flexible handle cross member 22 may be replaced entirely by an elastic cord or plurality of elastic cords attached to pressure plate 27. Furthermore, rigid non-supportive handle cross member **22*c*, pivot block 80, and pivot arm 81 may be accompanied by an identical cross member, pivot block, and pivot arm which are mirrored about the centerline of spindle 28. Such a configuration would actually draw a users fist against pressure pad 26. Although some form of adjustment would be required for the length or position of pivot arm 81 with this configuration. Otherwise the identical handle cross members may contact one another and support a user's fist by the palm away pressure pad 26**. Accordingly, the scope of the invention should be determined not by the embodiments illustrated, but by the appended claims and their legal equivalents.

I claim:

1. A punching handle accessory comprising:

a mounting bracket;

a pressure plate rotatably mounted to the mounting bracket for rotation about an axis generally normal to the side of the plate;

means for coupling a resistance to the mounting bracket at two places on generally opposite sides of the axis; and a non-supportive handle attached to the plate generally parallel the side opposite the mounting bracket whereby a user may place their knuckles against the side of the plate and grasp the non-supportive handle.

2. The accessory of claim 1 further comprising means for reducing the mounting bracket's tendency to spin about an axis perpendicular to said normal axis.

3. The accessory of claim 1 wherein the non-supportive handle is a flexible line.

4. The accessory of claim 3 wherein one end of the flexible line is secured at on end of the plate and the other end of the flexible line is threaded through a guide on the other end of the plate.

5. The accessory of claim 1 wherein the non-supportive handle comprises a bar and means for guiding the bar along an axis generally parallel the normal axis.

6. The accessory of claim 5 wherein the guiding means comprises the ends of the bar engaging guide slots attached to the plate.

7. The accessory of claim 5 wherein the guiding means comprises openings in the bar engaging guide posts attached to the plate.

8. The accessory of claim 7 wherein the openings are elongated along the axis of the bar.

9. The accessory of claim 1 wherein the non-supportive handle comprises a bar pivotally attached to the plate for movement about an axis generally perpendicular the normal axis.

10. The accessory of claim 1 further comprising a pad secured to the side of the plate for protecting the user's knuckles.

11. The accessory of claim 1 wherein the resistance coupling means comprises apertures in the mounting bracket.

* * * * *